US006767378B2

(12) United States Patent
Nishiyama et al.

(10) Patent No.: US 6,767,378 B2
(45) Date of Patent: Jul. 27, 2004

(54) EXHAUST GAS PURIFYING SYSTEM FOR INTERNAL COMBUSTION ENGINE

(75) Inventors: Toshihiko Nishiyama, Oyama (JP); Koutarou Wakamoto, Oyama (JP); Nobuhiko Emori, Oyama (JP)

(73) Assignee: Komatsu Ltd. (JP)

( * ) Notice: Subject to any disclaimer, the term of this patent is extended or adjusted under 35 U.S.C. 154(b) by 0 days.

(21) Appl. No.: 10/245,374

(22) Filed: Sep. 18, 2002

(65) Prior Publication Data

US 2003/0051449 A1 Mar. 20, 2003

(30) Foreign Application Priority Data

Sep. 19, 2001 (JP) ..... 2001-285250

(51) Int. Cl.[7] ..... B01D 29/56

(52) U.S. Cl. ..... 55/309; 55/343; 55/418; 55/482; 55/484; 55/DIG. 30

(58) Field of Search ..... 55/309, 482, 523, 55/418, 343, 484, DIG. 30; 60/311

(56) References Cited

U.S. PATENT DOCUMENTS

RE33,118 E * 11/1989 Scheitlin et al. ..... 60/299
6,464,744 B2 * 10/2002 Cutler et al. ..... 55/482

* cited by examiner

*Primary Examiner*—Robert A. Hopkins
(74) *Attorney, Agent, or Firm*—Rader, Fishman & Grauer PLLC

(57) ABSTRACT

In an exhaust gas purifying system 1, a pair of carriers 34 is arranged in series along the flow direction of exhaust gas. Approximately a half of the exhaust gas passing through a first distribution flow path 4 flows in the upstream-side carrier 34, and the remaining half of the exhaust gas passing through a second distribution flow path 5 flows in the downstream-side carrier 34. Therefore, the capacity of the whole of the paired carriers 34 can be substantially doubled as in the case where the carriers 34 are arranged in parallel, so that the function as the exhaust gas purifying system 1 can be improved.

10 Claims, 8 Drawing Sheets

EXHAUST GAS PURIFYING SYSTEM FOR INTERNAL COMBUSTION ENGINE

BACKGROUND OF THE INVENTION

1. Field of the Invention

The present invention relates to an exhaust gas purifying system for an internal combustion engine and, more particularly, to an exhaust gas purifying system provided in an exhaust passage of the internal combustion engine to purify exhaust gas.

2. Description of Related Art

Conventionally, it is known that an exhaust gas purifying system is provided in an exhaust passage of an internal combustion engine to collect particulates (particulate substances) in exhaust gas emitted from the internal combustion engine such as a diesel engine or to reduce NOx content.

As an exhaust gas purifying system for collecting particulates, a system provided with an exhaust emission after-treatment device consisting of a diesel particulate filter (hereinafter referred to as a DPF) has been developed.

As an exhaust gas purifying system for reducing NOx content, a system provided with an exhaust emission after-treatment device consisting of a NOx reduction catalyst (DeNOx catalyst) or a NOx occlusion reduction catalyst has been developed.

In both cases, the exhaust emission after-treatment device of the exhaust gas purifying system uses, for example, a columnar carrier (core) formed of a ceramic material such as cordulite and silicon carbide or a metal. This carrier has a construction such that a large number of small holes are formed in the axial direction in a honeycomb shape.

In the exhaust emission after-treatment device provided with the DPF, the carrier has a function as a filter. Specifically, exhaust gas flows into the carrier from one end face of the carrier, passing through a porous wall (boundary wall) separating the small holes, and flows out of the other end face. When the exhaust gas passes through the wall, particulates in the exhaust gas are collected.

Also, in the exhaust emission after-treatment device provided with the NOx reduction catalyst or the NOx occlusion reduction catalyst, various types of catalysts have been carried in advance in the carrier, and NOx is reduced during the time when exhaust gas flows in the carrier.

Such a carrier has many limitations in manufacturing, so that it is difficult to manufacture a carrier having a remarkably large cross-sectional shape. Therefore, the capacity of the whole carrier must be increased. That is, in order to increase the collecting efficiency of the DPF or to increase the reducing efficiency of the catalyst, a plurality of carriers must be arranged in parallel to increase the capacity of the whole carrier.

However, if a plurality of carriers are arranged in parallel, the cross-sectional area of the whole carrier increases, so that a large space for arranging the carriers must be secured in an engine room, which presents a problem of hindering the downsizing of equipment.

To solve this problem, a system as described below can be thought. In this system, a pair of carriers are arranged in series with a clearance provided therebetween, and exhaust gas is caused to flow into between the carriers, by which a half of the exhaust gas is caused to flow into one carrier and the remaining half of the exhaust gas is caused to flow in the reverse direction so as to flow into the other carrier. Thereby, the capacity of the whole carrier can be doubled without arranging a pair of carriers in parallel.

In this system, however, although a large cross-sectional area is restrained, the flow direction of exhaust gas in each of the carriers is reverse, so that two outlet pipes are needed, and some consideration is still needed for the arrangement space. Therefore, there still remains a problem to be solved.

SUMMARY OF THE INVENTION

The main object of the present invention is to provide an exhaust gas purifying system for an internal combustion engine in which the inherent function can be improved by increasing the capacity of the whole of carriers and a large installation space is made unnecessary.

The present invention provides an exhaust gas purifying system for an internal combustion engine, which is provided in an exhaust flow path of the internal combustion engine, including a plurality of carriers for exhaust emission after-treatment arranged in series along the flow direction of exhaust gas; a distribution flow path for distributing exhaust gas to each of the carriers to cause the exhaust gas to flow in the carrier; and a combined flow chamber in which the exhaust gases having passed through the distribution flow paths are combined.

In the above-described exhaust gas purifying system, although the carriers are arranged in series, the exhaust gas passing through a different distribution flow path flows in each of the carriers. Therefore, the capacity of the whole of the carriers increases substantially a plurality of times as in the case of the carriers arranged in parallel, so that the inherent function as an exhaust gas purifying system is improved.

Also, since the exhaust gases having passed through the distribution flow paths are combined in the combined flow chamber, only one outlet pipe communicating with the combined flow chamber has only to be provided. Therefore, an increase in cross-sectional area is restrained because the carriers are arranged in series, and a large installation space is unnecessary because the number of outlet pipes need not be increased.

The present invention provides an exhaust gas purifying system for an internal combustion engine, which is provided in an exhaust flow path of the internal combustion engine, including a plurality of carriers for exhaust emission after-treatment arranged in series along the flow direction of exhaust gas; and a distribution flow path for distributing exhaust gas to each of the carriers to cause the exhaust gas to flow in the carrier; the flow direction of the exhaust gas being set in one direction.

In the above-described exhaust gas purifying system, as in the case of the before-mentioned construction, the capacity of the whole of the carriers increases substantially a plurality of times as in the case of the carriers arranged in parallel, so that the inherent function as an exhaust gas purifying system is improved.

Also, since the flow direction of the exhaust gas flowing in each of the carriers is the same, the exhaust gases having passed through the distribution flow paths are combined easily at one place, so that only one outlet pipe has only to be provided in this combined flow portion. In this case as well, therefore, an increase in cross-sectional area is restrained because the carriers are arranged in series, and a large installation space is unnecessary because the number of outlet pipes need not be increased.

In the present invention, it is preferable that two of the carriers be arranged in series on the upstream side and the downstream side; a bypass flow path be provided on a concentric circle of each of the carriers; between the carriers, there be provided a split flow portion provided with an outlet space in which the exhaust gas having passed through the upstream-side carrier flows, an inlet space in which the exhaust gas to be caused to flow in the downstream-side carrier flows, and a wall portion for partitioning the spaces; a first distribution flow path for the upstream-side carrier be formed so as to include the outlet space of the split flow portion and the downstream-side bypass flow path communicating with the outlet space; and a second distribution flow path for the downstream-side carrier be formed so as to include the upstream-side bypass flow path and the inlet space of the split flow portion communicating with the upstream-side bypass flow path.

According to the above-described exhaust gas purifying system, since two carriers are provided, the capacity is substantially doubled as compared with the case where one carrier is provided.

Further, since the bypass flow path of the first and second distribution flow paths for each carrier is provided on a concentric circle of the carrier, the cross section thereof is formed so as to be annular, fan-shaped, or cylindrical, so that there is no fear of extremely projecting from the carrier. Therefore, the exhaust gas purifying system is formed so as to have a simple outside shape, and also can be made more compact.

In the present invention, it is preferable that there be provided a plurality of carrier arrangement units in which the carrier is arranged individually and a split flow unit provided between the adjacent carrier arrangement units; each of the carrier arrangement units be provided with a bypass flow path on a concentric circle of the carrier; the split flow unit be provided with a split flow portion provided with an outlet space in which the exhaust gas having passed through the upstream-side carrier flows, an inlet space in which the exhaust gas to be caused to flow in the downstream-side carrier flows, and a wall portion for partitioning the spaces; a distribution flow path for the upstream-side carrier be formed so as to include the outlet space of the split flow portion and the downstream-side bypass flow path communicating with the outlet space; and a distribution flow path for the downstream-side carrier be formed so as to include the upstream-side bypass flow path and the inlet space of the split flow portion communicating with the upstream-side bypass flow path.

According to the above-described exhaust gas purifying system, the whole of the system is unitized by the plural carrier arrangement units and the split flow unit. Therefore, the carrier can be replaced easily in a unit, and the handling ability is improved by the interchangeability of carrier arrangement unit. Also, the kinds of members are reduced.

The carrier arrangement unit can be formed so as to be capable of being used by reversing the upstream side and the downstream side. Particularly when the carrier is used as a DPF, the application efficiency is improved by using the carrier arrangement unit by being turned.

In the present invention, it is preferable that the split flow unit have a double tube construction provided with an external cylindrical member and an internal cylindrical member; the internal cylindrical member be provided with at least a pair of opening portions for causing external and internal space portions to communicate with each other; in the internal cylindrical member, an internal wall for separating the paired opening portions be provided; between the external cylindrical member and the internal cylindrical member, an external wall for separating the paired opening portions be provided; the outlet space be formed by the external and internal space portions of the internal cylindrical member which are caused to communicate with each other by either one of the paired opening portions; the inlet space be formed by the external and internal space portions of the internal cylindrical member which are caused to communicate with each other by the other one of the paired opening portions; and the wall portion be formed by the internal wall and the external wall.

According to the above-described exhaust gas purifying system, by merely using the split flow unit, the exhaust gas having flowed in the upstream-side carrier passes through the outlet space having the opening portion and flows in the downstream-side bypass flow path, and the exhaust gas having flowed in the upstream-side bypass flow path passes through the inlet space having the opening portion and flows in the downstream-side carrier. Therefore, the distribution flow path for each carrier is formed easily.

In the present invention, it is preferable that the internal wall be tilted with respect to the flow direction of the exhaust gas in the carrier; and the opening portion be open along the peripheral edge of the internal wall.

According to the above-described exhaust gas purifying system, since the internal wall is tilted, in the outlet space, the exhaust gas having passed through the upstream-side carrier is introduced smoothly to the opening portion along the tilted internal wall, so that the exhaust gas is discharged efficiently.

Also, in the inlet space, the exhaust gas entering the inlet space through the opening portion collides with the tilted internal wall and hence the flow thereof is straightened. Therefore, the flow distribution is improved, and then the exhaust gas flows into the downstream-side carrier, so that the tilted surface of the internal wall can also be used as a flow straightening device.

In the present invention, it is preferable that a flow straightening device for straightening the flow of exhaust gas flowing in the carrier be provided on the upstream side of each of the carriers.

According to the above-described exhaust gas purifying system, since the flow distribution of the exhaust gas flowing into the carrier is improved, there is no fear of exhaust gas flowing concentratedly into a part of carrier. Therefore, when the carrier is used by carrying a catalyst therein, only a part of the catalyst is not exposed to exhaust gas concentratedly, so that the catalytic action can be accomplished efficiently. Also, when the carrier is used as a DPF, the carrier is not clogged with particulates non-uniformly, so that the temperature distribution at the time of recycling the carrier is uniformized, by which the breakage of the carrier caused by the thermal stress is prevented.

In the present invention, it is preferable that an inlet pipe for causing exhaust gas to flow into the exhaust gas purifying system and an outlet pipe for discharging exhaust gas from the exhaust gas purifying system be installed substantially at right angles with the flow direction of exhaust gas in the carrier.

According to the above-described exhaust gas purifying system, since the inlet pipe and the outlet pipe are installed substantially at right angles with the flow direction of exhaust gas in the carrier, the layout of the inlet pipe and the outlet pipe is accomplished easily. Therefore, the exhaust gas purifying system can be made more compact, and can be installed in a smaller installation space.

DETAILED DESCRIPTION OF PREFERRED EMBODIMENT

One embodiment of the present invention will now be described with reference to the accompanying drawings.

Figure 1:
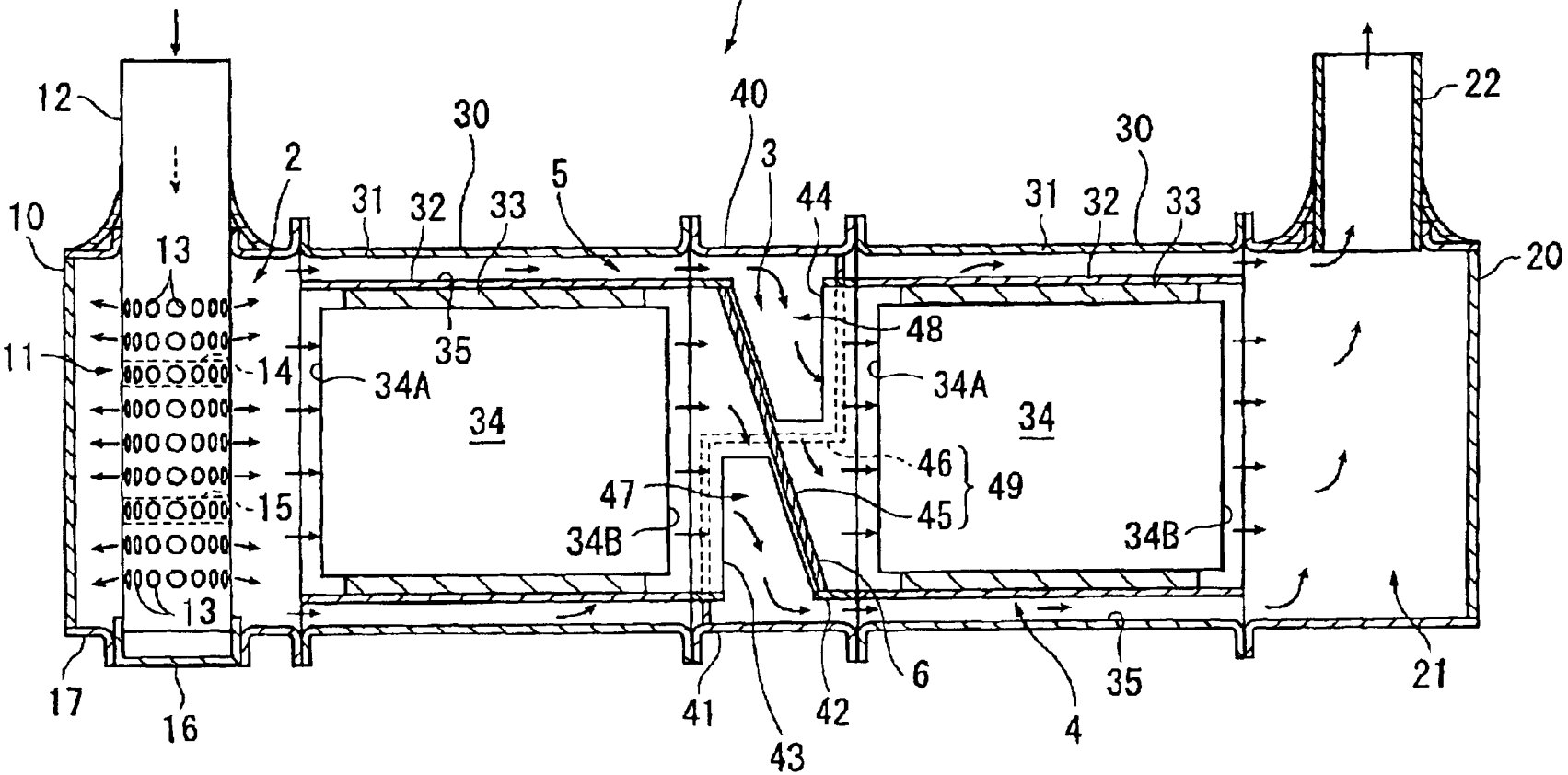
FIG. 1 is a sectional view showing the whole of an exhaust gas purifying system in accordance with one embodiment of the present invention.

FIG. 1 shows an exhaust gas purifying system 1 in accordance with one embodiment of the present invention. This exhaust gas purifying system 1 is provided halfway in an exhaust passage of a diesel engine (not shown), one type of an internal combustion engine, to purify exhaust gas emitted from the diesel engine.

Specifically, the exhaust gas purifying system 1 includes an inlet chamber unit 10 provided on the inflow side of exhaust gas, a combined flow chamber unit 20 provided on the discharge side of exhaust gas, a pair of carrier arrangement units 30 disposed in series along one flow direction of exhaust gas flowing from the inlet chamber unit 10 to the combined flow chamber unit 20, and a split flow unit 40 disposed between the carrier arrangement units 30.

These units 10, 20, 30 and 40 are formed into a cylindrical shape and are connected to each other by bolts and nuts or other means at adjacent flange portions.

Figure 2:
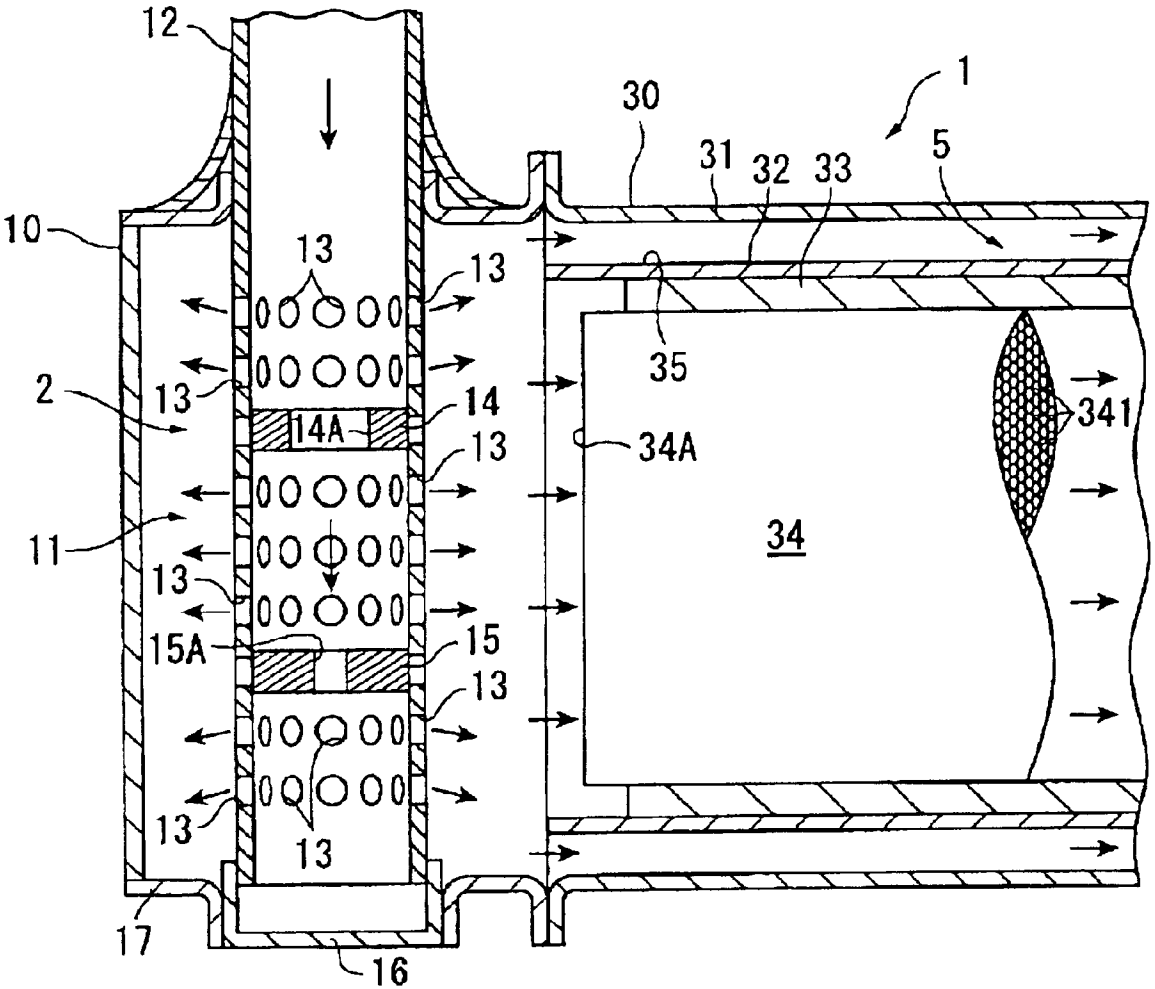
FIG. 2 is a sectional view showing an essential portion of the exhaust gas purifying system shown in FIG. 1.

As shown enlargedly in FIG. 2, the inlet chamber unit 10 of the exhaust gas purifying system 1 has an inlet chamber 11 on the inside thereof. In this inlet chamber 11, an inlet pipe 12 connected to the exhaust passage of diesel engine is inserted. The insertion direction of the inlet pipe 12 is the direction perpendicular to the flow direction of exhaust gas flowing in the carrier arrangement unit 30 (later-described carrier).

In a portion of the inlet pipe 12 contained in the inlet chamber 11, many round holes 13 are formed around substantially entire circumference. The exhaust gas blown out of these round holes 13 enters the inlet chamber 11. On the inside of the inlet pipe 12, a pair of resistance plates 14 and 15 are fixed on the upstream side and the downstream side of the flow direction of exhaust gas by welding or other means with a space provided therebetween. Each of the resistance plates 14 and 15 is formed with a through hole 14A, 15A in the center thereof. The through hole 14A in the upstream-side resistance plate 14 has a larger diameter than that of the through hole 15A in the downstream-side resistance plate 15.

These resistance plates 14 and 15 function as described below. The flow of exhaust gas flowing in the inlet pipe 12 is first hindered by the upstream-side resistance plate 14, so that the exhaust gas easily enters the inlet chamber 11 in front of the resistance plate 14. Next, the exhaust gas that passes through the through hole 14A in the resistance plate 14 and flows toward the downstream side is hindered by the resistance plate 15, and hence the exhaust gas easily enters the inlet chamber 11 also in front of the resistance plate 15. The exhaust gas that has passed through the through hole 15A in the resistance plate 15 enters the inlet chamber 11 through the round holes 13 in rear of the resistance plate 15.

Because of this construction, the exhaust gas in the inlet pipe 12 does not enter the inlet chamber 11 concentratedly by flowing to the tip end on the downstream side straightly, but enters the inlet chamber 11 uniformly from the whole of the inlet pipe 12. Specifically, by providing the resistance plates 14 and 15, the flow distribution of exhaust gas is improved so that the flow distribution of exhaust gas flowing from the inlet chamber unit 10 to the next carrier arrangement unit 30 is uniform. Thus, a flow straightening device 2 in accordance with the present invention is formed so as to include the inlet pipe 12 formed with the round holes 13 and the resistance plates 14 and 15 provided in the inlet pipe 12.

The tip-end portion of the inlet pipe 12 is not fixed to a short tube member 16 of a bottomed cylindrical shape by welding or other means, but is press fitted thereto. The short tube member 16 is fixed to a cylindrical member 17 forming the contour of the inlet chamber unit 10. A gap is formed between the tip end of the inlet pipe 12 and a bottom portion of the short tube member 16. Therefore, even if the inlet pipe 12 is thermally expanded by exhaust gas, the thermal expansion is absorbed by the gap, so that the cylindrical member 17 etc. are prevented from being broken.

The combined flow chamber unit 20 is constructed so that the interior thereof is used as a combined flow chamber 21. In the combined flow chamber 21, exhaust gases having passed separately through each of the carrier arrangement units 30 are combined. The combined exhaust gas passes through an exhaust pipe via an outlet pipe 22 and is discharged to the atmosphere. The outlet pipe 22 is, like the inlet pipe 12, installed in the direction perpendicular to the flow direction of exhaust gas flowing in the carrier arrangement unit 30 (later-described carrier). For the outlet pipe 22, however, the substantially whole pipe protrudes to the outside of the combined flow chamber 21, and a portion contained in the combined flow chamber 21 scarcely exists.

For the carrier arrangement units 30, the upstream-side unit 30 and the downstream-side unit 30 have the same shape, and each of the carrier arrangement units 30 has a double tube construction having an external cylindrical member 31 which forms the contour of the carrier arrangement unit 30 and an internal cylindrical member 32 contained in the external cylindrical member 31. In the internal cylindrical member 32, a carrier 34 is arranged via a cushioning member 33 having elasticity. Also, as is apparent from FIG. 1, the carrier arrangement unit 30 has a point symmetric construction, and can also be used by being turned 180 degrees.

The carrier 34 has a construction such that a large number of small holes 341 of a honeycomb shape are arranged. The small hole 341 leads from an inflow-side end face 34A to an outflow-side end face 34B, that is, in the axial direction of the carrier 34, and the cross section thereof is formed into a polygonal shape (in this embodiment, hexagonal shape).

The carrier 34 is formed of a ceramic material such as cordulite and silicon carbide or a metal such as stainless steel and aluminum. The material thereof is determined appropriately according to the application of the carrier 34.

When the carrier 34 is used as a DPF, the small holes 341 are divided into small holes 341 having a role as an inflow-side flow path by closing the outflow-side end face 34B and small holes 341 having a role as an outflow-side flow path by closing the inflow-side end face 34A, and these flow paths are arranged in a zigzag form. A boundary wall portion of the flow paths (small holes 341) is of a random porous shape, so that particulates (for example, compound materials composed of soot, mist of unburned fuel or lubricating oil, sulfate (sulfuric acid mist), etc.) in exhaust gas flowing into the carrier 34 through the inflow-side flow path are collected in the boundary wall portion and accumulate in the inflow-side flow path, by which clean exhaust gas from which the particulates have been removed is discharged through the outflow-side flow path.

On the other hand, when a catalyst is carried in the carrier 34, the catalyst is carried in the carrier 34 by a widely known method such as impregnation by dipping, wash coat, and ion exchange. During the time when exhaust gas passes through the small holes 341, the exhaust gas is purified and made clean by the action of the catalyst.

As a catalyst carried in the carrier 34, a NOx occlusion reduction catalyst or a NOx occlusion catalyst for removing NOx (nitrogen oxides), an oxidation catalyst for oxidizing and removing HC and CO (carbon monoxide), a three way catalyst for removing hydrocarbon, carbon monoxide, and nitrogen oxides, or the like can be used.

In the above-described carrier arrangement unit 30, the external cylindrical member 31 and the internal cylindrical member 32 are joined to each other via a bracket (not shown) provided discontinuously in the peripheral direction with a clearance provided therebetween. The clearance between the external cylindrical member 31 and the internal cylindrical member 32 serves as a bypass flow path 35 of an annular shape in cross section provided on a concentric circle on the outer peripheral side of the carrier 34. Specifically, the exhaust gas passing through the carrier arrangement unit 30 is divided into exhaust gas passing through the carrier 34 itself and exhaust gas passing through the bypass flow path 35 on the outer peripheral side of the carrier 34. The cross-sectional area of the bypass flow path 35 is determined so as to be in a range such that the pressure loss is sufficiently low and the area is small.

The split flow unit 40 has an external cylindrical member 41 and an internal cylindrical member 42. This split flow unit 40 also has a point symmetric construction, and can be used by being turned 180 degrees.

Figure 3:
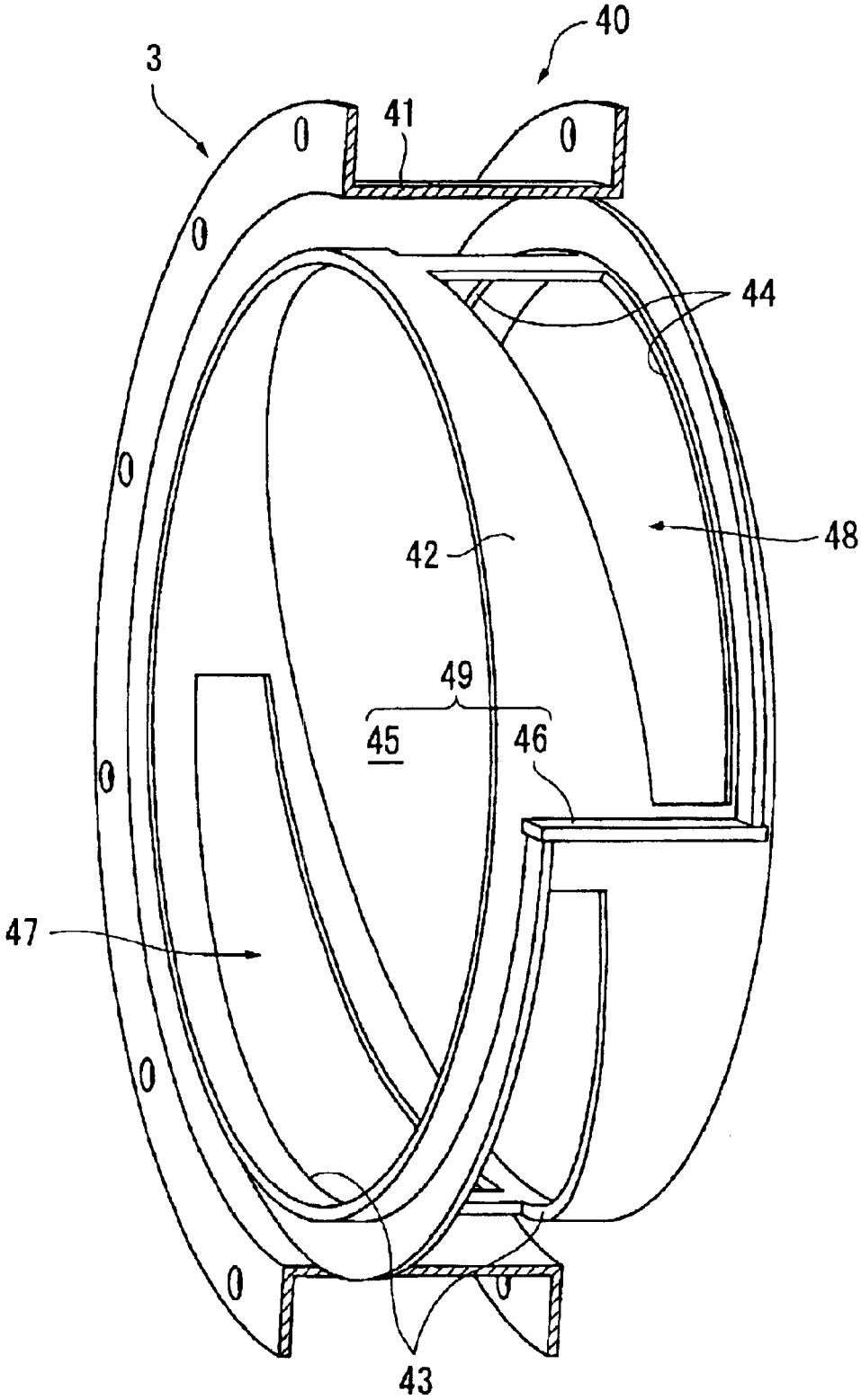
FIG. 3 is an enlarged perspective view of a component of the exhaust gas purifying system shown in FIG. 1.

As enlargedly shown in FIG. 3 as well, the internal cylindrical member 42 is provided with an outlet-side opening portion (opening portion) 43 substantially over a semicircle on the lower side in the figure and an inlet-side opening portion (opening portion) 44 substantially over a semicircle on the remaining upper side. The external and internal space portions of an internal cylindrical member 42 communicate with each other by means of these opening portions 43 and 44.

In the internal cylindrical member 42, an internal wall 45 is provided to separate the outlet-side opening portion 43 from the inlet-side opening portion 44, so that the exhaust gases flowing in and out through the openings 43 and 44 are prevented from mixing with each other within the internal cylindrical member 42.

The internal wall 45 is tilted relative to the flow direction of exhaust gas flowing in the carrier 34. By the tilt of the internal wall 45, an internal space portion in the internal cylindrical member 42 that is open toward the upstream-side carrier arrangement unit 30 is spread toward the lower side in the figure. By utilizing a lower-side semicircular portion of the internal cylindrical member 42 that forms this spread portion, the outlet-side opening portion 43 is opened large. Specifically, one edge in the circumferential direction of the outlet-side opening portion 43 is provided closely along the peripheral edge of the outer peripheral edge of the internal cylindrical member 42, and the other edge in the circumferential direction is provided closely along the peripheral edge of the internal wall 45. Thereby, the opening area of the outlet-side opening portion 43 is made as large as possible.

The same holds true for the inlet-side opening portion 44 on the upper side in the figure, which lies at a position symmetrical with the outlet-side opening portion 43. That is, the opening area of the inlet-side opening portion 44 has a sufficiently large opening area.

On the other hand, in a clearance between the external cylindrical member 41 and the internal cylindrical member 42, an external wall 46 is provided to separate the outlet-side opening portion 43 from the inlet-side opening portion 44.

The external wall 46 is provided continuously in the circumferential direction so as to divide the clearance into two: the outlet-side opening portion 43 side and the inlet-side opening portion 44 side. Therefore, the exhaust gases flowing in and out through the opening portions 43 and 44 are also prevented from mixing with each other within the clearance.

Of the clearances partitioned by the external wall 46, the clearance on the side of the outlet-side opening portion 43, that is, one external space portion viewed from the internal cylindrical member 42 is open toward the downstream-side carrier arrangement unit 30. On the other hand, the clearance on the side of the inlet-side opening portion 44, that is, the other external space portion viewed from the internal cylindrical member 42 is open toward the upstream-side carrier arrangement unit 30.

An outlet space 47 is formed by the external and internal space portions of the internal cylindrical member 42 communicating with each other via the outlet-side opening portion 43, and an inlet space 48 is formed by the external and internal space portions of the internal cylindrical member 42 communicating with each other via the inlet-side opening portion 44.

Also, a wall portion 49 is formed by the internal wall 45 and the external wall 46 that separate the outlet space 47 from the inlet space 48.

Further, a split flow portion 3 in accordance with the present invention is formed by the outlet space 47, the inlet space 48, and the wall portion 49. Therefore, the split flow unit 40 is a unit that is provided with the split flow portion 3.

The above-described split flow unit 40 is connected to the upstream-side and downstream-side carrier arrangement units 30. Thereby, the external cylindrical members 31 and 41 are joined to each other, and also the internal cylindrical members 32 and 42 are joined to each other.

By the connection of the units 30 and 40, the outlet space 47 of the split flow unit 40 and the bypass flow path 35 of the downstream-side carrier arrangement unit 30 are caused to communicate with each other, and a first distribution flow path 4 for the upstream-side carrier 34 is formed so as to include these elements.

Also, the upstream-side bypass flow path 35 and the inlet space 48 of the split flow unit 40 are caused to communicate with each other, and a second distribution flow path 5 for the downstream-side carrier 34 is formed so as to include these elements.

The operation of the exhaust gas purifying system 1 constructed as described above will be described with reference to FIG. 1. Approximately a half of the exhaust gas sent from the inlet chamber unit 10 enters the combined flow chamber unit 20 after passing through the first distribution flow path 4. Specifically, it flows from the inlet pipe 12 to the inlet chamber 11, to the upstream-side carrier 34, to the outlet space 47 (outlet-side opening portion 43), to the downstream-side bypass flow path 35, and to the combined flow chamber 21, and is discharged through the outlet pipe 22.

At this time, in the outlet space 47, the exhaust gas sent from the upstream-side carrier 34 flows smoothly to the outlet-side opening portion 43 along the tilted surface of the internal wall 45, and is discharged efficiently from the outlet-side opening portion 43 that is open large.

The remaining half of the exhaust gas enters the combined flow chamber unit 20 after passing through the second distribution flow path 5. Specifically, it flows from the inlet pipe 12 to the inlet chamber 11, to the upstream-side bypass flow path 35, to the inlet space 48 (inlet-side opening portion 44), to the downstream-side carrier 34, and to the combined flow chamber 21, and is discharged through the outlet pipe 22.

At this time, in the inlet space 48, part of the exhaust gas entering through the inlet-side opening portion 44 collides with the tilted surface of the internal wall 45, by which the flow direction is changed so as to be directed toward the downstream-side carrier 34 on the way to reaching the lower part in FIG. 1, and the flow distribution is uniformized just before the exhaust gas enters the carrier 34. That is to say, the tilted wall surface of the internal wall 45 functions as a flow straightening device 6 for the downstream-side carrier 34.

Thus, the exhaust gases divided into two by the upstream-side carrier arrangement unit 30 pass through the carriers 34 without being mixed with each other halfway, being combined in the combined flow chamber 21, and are discharged through one outlet pipe 22.

According to this embodiment as described above, the following effects can be achieved.

(1) In the exhaust gas purifying system 1, the paired carriers 34 are arranged in series along the flow direction of exhaust gas, and approximately a half of the exhaust gas, which passes through the first distribution flow path 4, flows in the upstream-side carrier 34, and the remaining half of the exhaust gas, which passes through the second distribution flow path 5, flows in the downstream-side carrier 34. Therefore, the capacity of the whole of the paired carriers 34 can be substantially doubled as in the case where the carriers 34 are arranged in parallel, so that the function as the exhaust gas purifying system 1 can be improved.

(2) Also, since the exhaust gases having passed through the first and second distribution flow paths 4 and 5 are combined in the downstream-side combined flow chamber 21, the exhaust gases can be discharged through only one outlet pipe 22 provided so as to communicate with the combined flow chamber 21. Therefore, an increase in cross-sectional area can be restrained by arranging the carriers 34 in series, and also the number of outlet pipes can be kept to the minimum, so that the large installation space for installing the exhaust gas purifying system 1 can be made unnecessary.

(3) Since, as shown in FIG. 1, the exhaust gas flowing in the carriers 34 flows from the left-hand side to the right-hand side in the figure, the exhaust gases having passed through the first and second distribution flow paths 4 and 5 can be combined easily in one combined flow chamber 21, so that the exhaust gas can be discharged surely through one outlet pipe 22.

(4) Since the bypass flow paths 35 constituting the first and second distribution flow paths 4 and 5 are provided on a concentric circle on the outer peripheral side of the carrier 34, the cross section of the bypass flow path 35 can be formed in an annular shape around the entire circumference of the carrier 34, so that there is no fear of extremely projecting in the radial direction of the carrier 34. Therefore, the exhaust gas purifying system 1 can be formed so as to have a substantially cylindrical simple outside shape, and also can be made more compact.

(5) Since the exhaust gas purifying system 1 is constructed so as to include the inlet chamber unit 10, the combined flow chamber unit 20, the carrier arrangement unit 30, and the split flow unit 40, each of which is unitized, for example, when the carrier 34 is replaced, it has only to be replaced as the carrier arrangement unit 30. Therefore, troublesome work for disassembling the carrier arrangement unit 30 can be made unnecessary, and the carrier 34 can be replaced easily.

(6) Since the paired carrier arrangement units 30 have the same shape and are interchangeable, they can be disposed arbitrarily either on the upstream side or on the downstream side, so that handling ability at the time of assembly can be improved. Also, since only one kind of the carrier arrangement unit 30 can be used, the kinds of members can be reduced, which decreases the production cost.

(7) Since the carrier arrangement unit 30 has a point symmetric construction, and can be used by being turned 180 degrees, especially when the carrier 34 is used as a DPF, the application efficiency can be improved by turning the carrier arrangement unit 30.

Also, since the carrier arrangement unit 30 can be used by being turned 180 degrees, for example, when a new unit is arranged, attention need not be paid to the direction thereof, which can also improve the handling ability.

Since the split flow unit 40 also has a point symmetric construction, when this unit is arranged as well, attention need not be paid to the direction thereof, which can improve the handing ability at the time of arrangement.

(8) Further, since both of the carrier arrangement units 30 and the split flow unit 40 have a point symmetric construction and moreover the carrier arrangement units 30 have the same shape, the paired carrier arrangement units 30 and the split flow unit 40 can also be used by being turned 180 degrees while being integrated. Therefore, the turning operation can be simplified as compared with the case where the carrier arrangement units 30 are turned individually.

(9) In addition, to connect the carrier arrangement units 30 and the split flow unit 40 to each other, the external cylindrical members 31 and 41 have only to be joined to each other and the internal cylindrical members 32 and 42 have only to be joined to each other, and attention need not be paid to the positional relation in the circumferential direction. Therefore, at the time of work for connecting the units 30 and 40 to each other, the positioning thereof can be performed easily, so that the connecting work can be performed rapidly.

(10) By use of the split flow unit 40, the exhaust gas having passed through the upstream-side carrier 34 can easily be caused to flow in the downstream-side bypass flow path 35 through the outlet space 47, and the exhaust gas having passed through the upstream-side bypass flow path 35 can easily be caused to flow in the downstream-side carrier 34 through the inlet space 48, by which the first and second distribution flow paths 4 and 5 for each of the carriers 34 can be formed easily.

(11) In the exhaust gas purifying system 1, the flow straightening device 2 including the inlet pipe 12 formed with the round holes 13 and the resistance plates 14 and 15 provided in the inlet pipe 12 is provided in the inlet chamber 11 of the inlet chamber unit 10. Therefore, the flow distribution of exhaust gas flowing into the upstream-side carrier 34 can be improved, and hence exhaust gas can be prevented from flowing into a part of the carrier 34 concentratedly.

(12) Therefore, when the carrier 34 is used by carrying a catalyst therein, only a part of the catalyst is prevented from being exposed to exhaust gas concentratedly, so that the catalytic action can be accomplished efficiently. Also, when the carrier is used as a DPF, the carrier can be prevented from being clogged with particulates non-uniformly, and the temperature distribution at the time of recycling the carrier 34 can be uniformized, so that the breakage of the carrier 34 caused by the concentration of thermal stress at a part can be prevented.

(13) The flow straightening device 2 serves to improve the flow distribution of the whole of exhaust gas flowing in the downstream direction from the inlet chamber 11. Therefore, the flow rate of exhaust gas entering the upstream-side carrier 34 (first distribution flow path 4) and the flow rate of exhaust gas entering the bypass flow path 35 (second distribution flow path 5) surrounding the carrier 34 can be made substantially uniform, so that the flow rate of exhaust gas passing through each of the carriers 34 is uniformized, whereby the purifying efficiency can further be increased.

Also, by the uniformization of flow rate, the service condition of each of the carriers 34 is made uniform, so that the maintainability can be improved; for example, both of the carriers 34 can be replaced at the same time.

(14) On the other hand, in the inlet space 48 of the split flow unit 40, the flow of exhaust gas having entered the inlet space 48 through the inlet-side opening portion 44 can be straightened by causing the exhaust gas to collide with the tilted surface of the internal wall 45, by which the flow distribution is improved so that the exhaust gas can flow into the downstream-side carrier 34. That is to say, the tilted wall surface of the internal wall 45 functions as the flow straightening device 6 for the downstream-side carrier 34 as well, so that this carrier 34 can also achieve the same effect as described in items (11) and (12).

(15) Also, by the tilt of the internal wall 45, in the outlet space 47, the exhaust gas having passed through the upstream-side carrier 34 can be introduced smoothly to the outlet-side opening portion 43 along the tilted surface of the internal wall 45, so that exhaust gas can be discharged efficiently.

In particular, in this embodiment, the outlet-side opening portion 43 and the inlet-side opening portion 44 are opened large by utilizing the overall width of the internal cylindrical member 42, so that the flow of exhaust gas can be made smooth in this respect as well.

(16) Since the inlet pipe 12 and the outlet pipe 22 are installed substantially at right angles with the flow direction of exhaust gas in the carrier 34, the layout of the inlet pipe 12 and the outlet pipe 22 can be accomplished easily. Therefore, the exhaust gas purifying system 1 can be made more compact, and can be installed in a smaller installation space.

The present invention is not limited to the above-described embodiment, and embraces other configurations capable of achieving the object of the present invention. The following modifications are embraced in the present invention.

[First Modification]

Figure 4:
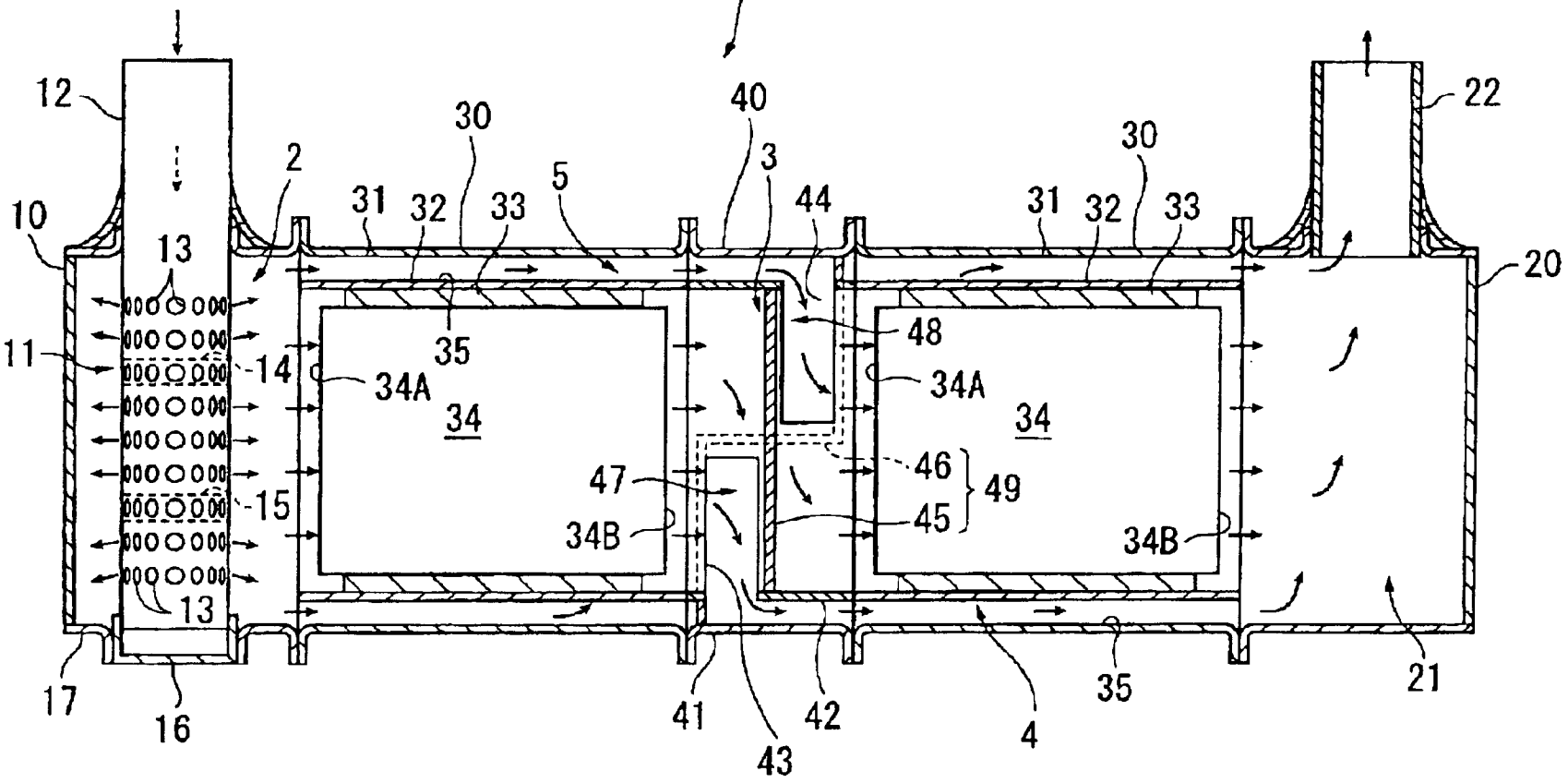
FIG. 4 is a sectional view showing a first modification of the present invention.

FIG. 4 shows an exhaust gas purifying system 101 in accordance with a first modification of the present invention. In FIG. 4, the same reference numerals as those in the above-described embodiment are applied to the same elements as those used in the above-described embodiment or the elements having the same function, and the explanation of the elements is omitted or simplified. The same holds true for the second and subsequent modifications.

In FIG. 4, the exhaust gas purifying system 101 of this first modification differs from the above-described embodiment in that the internal wall 45 of the split flow unit 40 is not tilted and is arranged at right angles with the flow direction of the exhaust gas flowing in the carrier 34, and accordingly the developed shapes of the outlet-side opening portion 43 and the inlet-side opening portion 44 are rectangular. Other constructions are almost the same as those of the embodiment.

Such a modification can achieve the above-described effects except the effects of items (14) and (15).

[Second Modification]

Figure 5:
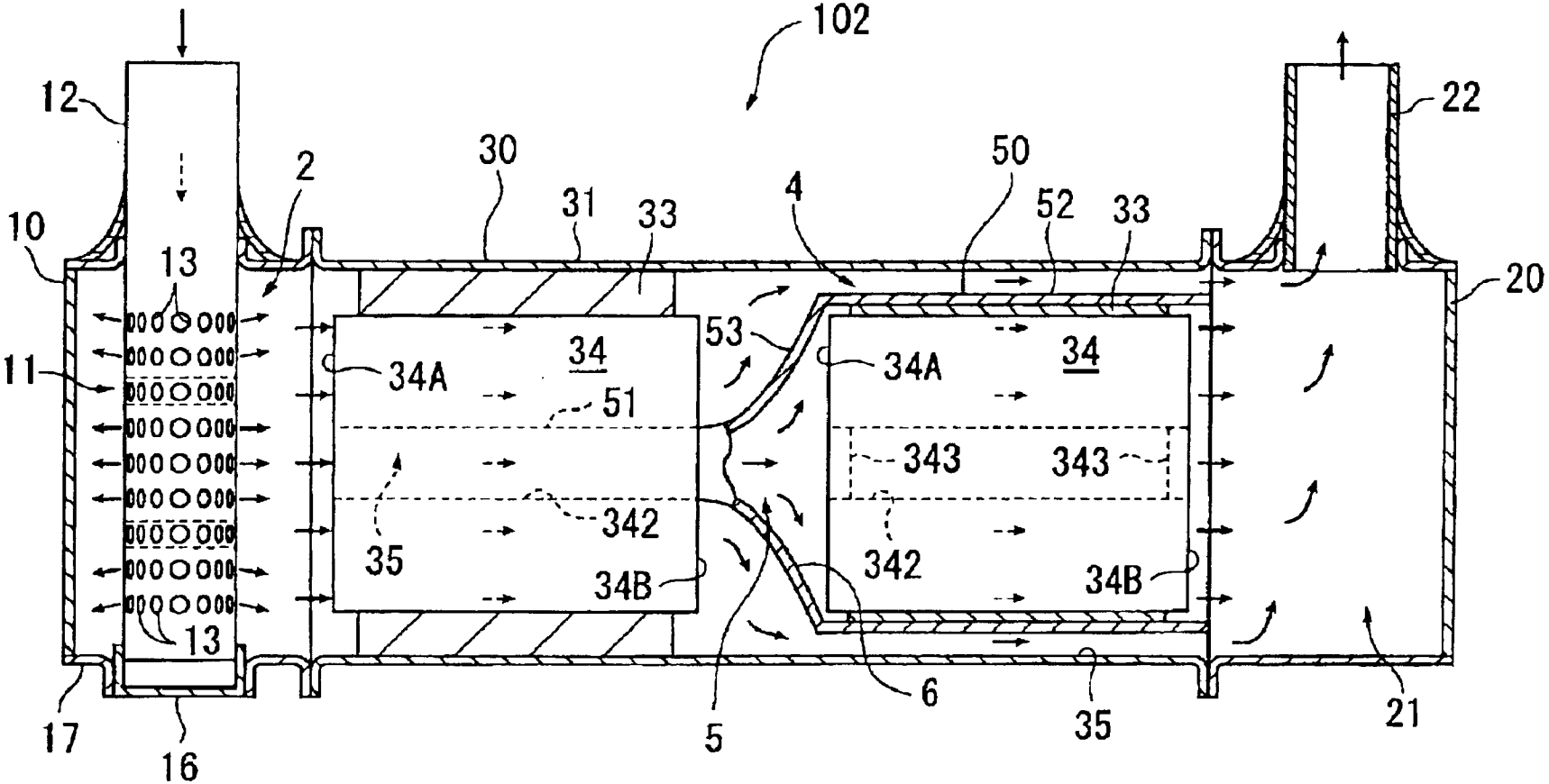
FIG. 5 is a sectional view showing a second modification of the present invention.

FIG. 5 shows an exhaust gas purifying system 102 in accordance with a second modification of the present invention.

The exhaust gas purifying system 102 of the second modification has a construction such that a pair of carriers 34 are arranged in series in one carrier arrangement unit 30, and does not have the split flow unit 40 in the above-described embodiment.

Specifically, the carrier arrangement unit 30 has a large external cylindrical member 31 disposed between the inlet chamber unit 10 and the combined flow chamber unit 20. In this external cylindrical member 31, the upstream carrier 34 is arranged via the cushioning member 33.

In the center of the upstream-side carrier 34, a large through hole 342 is formed along the flow direction of exhaust gas. In this through hole 342, the upstream-side portion of a distribution flow path forming member 50 is inserted.

The distribution flow path forming member 50 includes a small-diameter cylindrical portion 51 inserted in the through hole 342, a large-diameter cylindrical portion 52 provided on the downstream side, and a bell mouth portion 53 for connecting these cylindrical portions 51 and 52 to each other. The bell mouth portion 53 is open from the small-diameter cylindrical portion 51 toward the large-diameter cylindrical portion 52.

For the distribution flow path forming member 50, the small-diameter cylindrical portion 51 is supported on the external cylindrical member 31 via the upstream-side carrier 34 and the cushioning member 33, and the large-diameter cylindrical portion 52 is fixed to the external cylindrical member 31 via a plurality of brackets, not shown.

In the large-diameter cylindrical portion 52, the downstream-side carrier 34 is arranged via the cushioning member 33. This carrier 34 has the same shape as that of the upstream-side carrier 34, and is formed with a through hole 342 in the center. However, both ends of this through hole 342 are closed by closing members 343.

A space in the small-diameter cylindrical portion 51 serves as a cylindrical bypass flow path 35 provided on a concentric circle on the outer peripheral side of the carrier 34. A clearance is provided between the large-diameter cylindrical portion 52 and the external cylindrical member 31 and between the bell mouth portion 53 and the external cylindrical member 31. This clearance serves as the bypass flow path 35 of an annular shape in cross section provided on a concentric circle on the outer peripheral side of the carrier 34.

For the above-described carrier arrangement unit 30, the first distribution flow path 4 including the downstream-side bypass flow path 35 is formed, and the second distribution flow path 5 including the bypass flow path 35 in the small-diameter cylindrical portion 51 is formed.

Therefore, approximately a half of the exhaust gas sent from the inlet chamber 11 is caused to pass through only the upstream-side carrier 34 by flowing in the first distribution flow path 4, and the remaining half of the exhaust gas is caused to pass through only the downstream-side carrier 34 by flowing in the second distribution flow path 5. The exhaust gases flow without being mixed with each other halfway, being combined in the combined flow chamber 21, and are discharged subsequently.

For the bell mouth portion 53 of the distribution flow path forming member 50, the inner peripheral surface thereof functions as the flow straightening device 6. It diffuses the exhaust gas sent from the small-diameter cylindrical portion 51 toward the outside in the radial direction, and improves the flow distribution just in front of the downstream-side carrier 34.

Also, the exhaust gas having passed through the upstream-side carrier 34 flows along the outer peripheral surface of the bell mouth portion 53, and flows smoothly in the downstream-side bypass flow path 35.

In this modification as well, the effects of items (1) to (3), (5), (9), (11), (13) and (16) can be achieved by the same constructions as and the similar constructions to those of the above-described embodiment.

Also, the unique construction of the exhaust gas purifying system 102 achieves the following effects.

(17) The bypass flow path 35 of the second distribution flow path 5 is on the outer periphery side of the downstream-side carrier 34, as in the case of the above-described embodiment, and is provided on a concentric circle, so that it does not project greatly from the carrier 34 toward the outer periphery.

Also, the bypass flow path 35 of the first distribution flow path 4 is on the inner periphery side of the upstream-side carrier 34 and is provided on a concentric circle thereof, so that it does also not project toward the outer periphery side of the carrier 34.

Therefore, this modification can similarly achieves the effect of the above-described item (4) though the construction of the first distribution flow path 4 differs from that of the above-described embodiment.

(18) Further, in this modification as well, one carrier arrangement unit 30 can be used either on the upstream side or on the downstream side by being turned 180 degrees as a unit, so that the effect of item (8) of the above-described embodiment can be achieved though the construction differs from that of the embodiment.

(19) According to the bell mouth portion 53 of the distribution flow path forming member 50, in the first distribution flow path 5, exhaust gas flows smoothly along the outer peripheral surface, and in the second distribution flow path 4, the inner peripheral surface of the bell mouth portion 53 functions as the flow straightening device 6. In this case as well, therefore, the effects of the above-described items (14) and (15) can be achieved though the construction differs from that of the embodiment.

[Third Modification]

Figure 6:
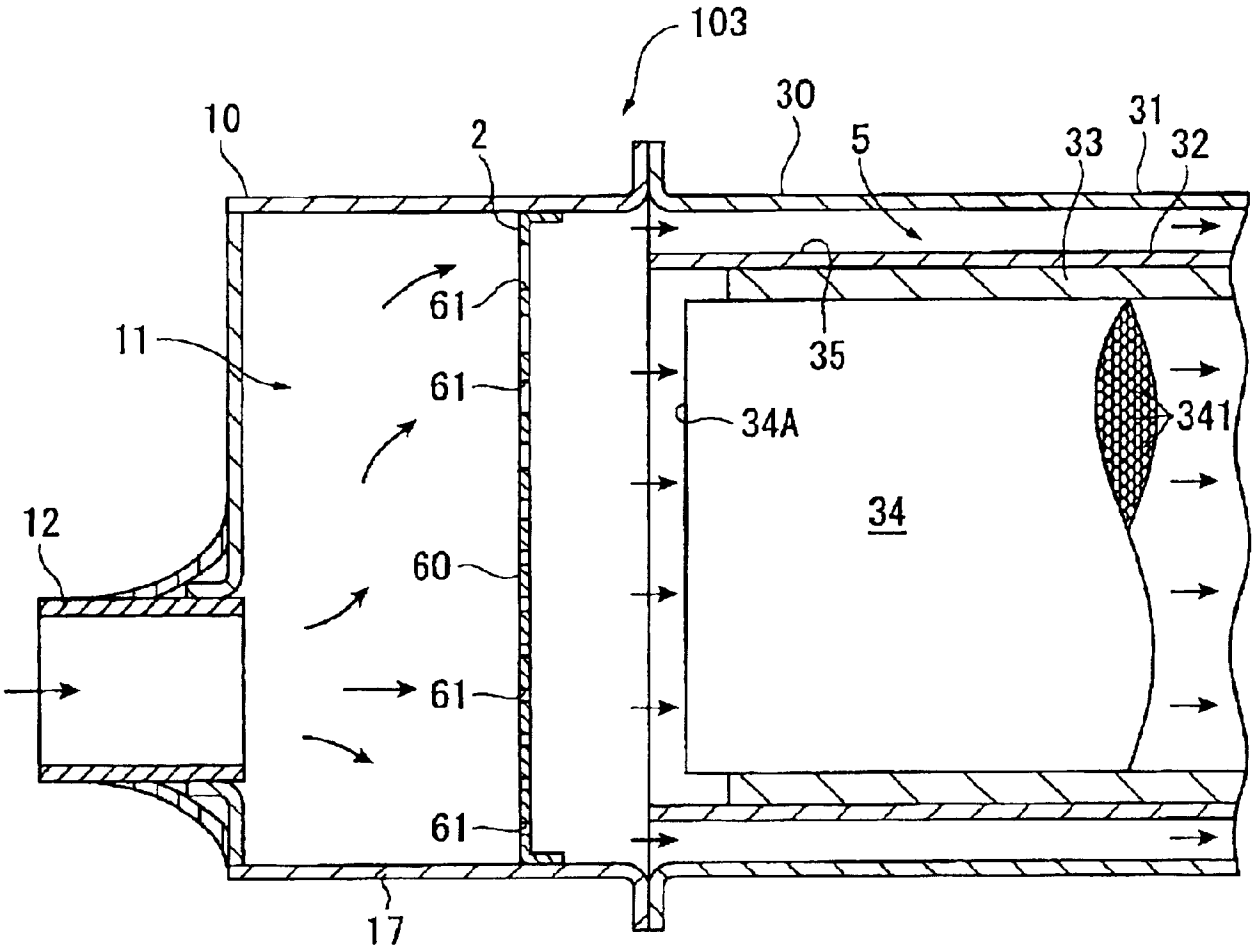
FIG. 6 is a sectional view showing a third modification of the present invention.

FIG. 6 shows an exhaust gas purifying system 103 in accordance with a third modification of the present invention.

The exhaust gas purifying system 103 of this third modification differs from the above-described embodiment in that the inlet pipe 12 is installed in the direction along the flow direction of the exhaust gas flowing in the carrier 34, and that the flow straightening device 2 is formed by a flow straightening grating 60 having a plurality of holes 61. Other constructions are almost the same as those of the embodiment.

In this modification, the opening area of each of the holes 61 in the flow straightening grating 60 are small at positions close to the inlet pipe 12 and is larger as the distance from the inlet pipe 12 increases. Thereby, the flow distribution of the exhaust gas passing through the flow straightening grating 60 is improved. However, in the case where a sufficient flow straightening effect can be achieved even if the holes 61 having the same opening area are formed, such a construction may be used.

In the above-described modification, although the effect of the above-described item (16) cannot be achieved, the effects of items (1) to (15) can similarly be achieved by the same or similar constructions.

[Fourth Modification]

Figure 7:
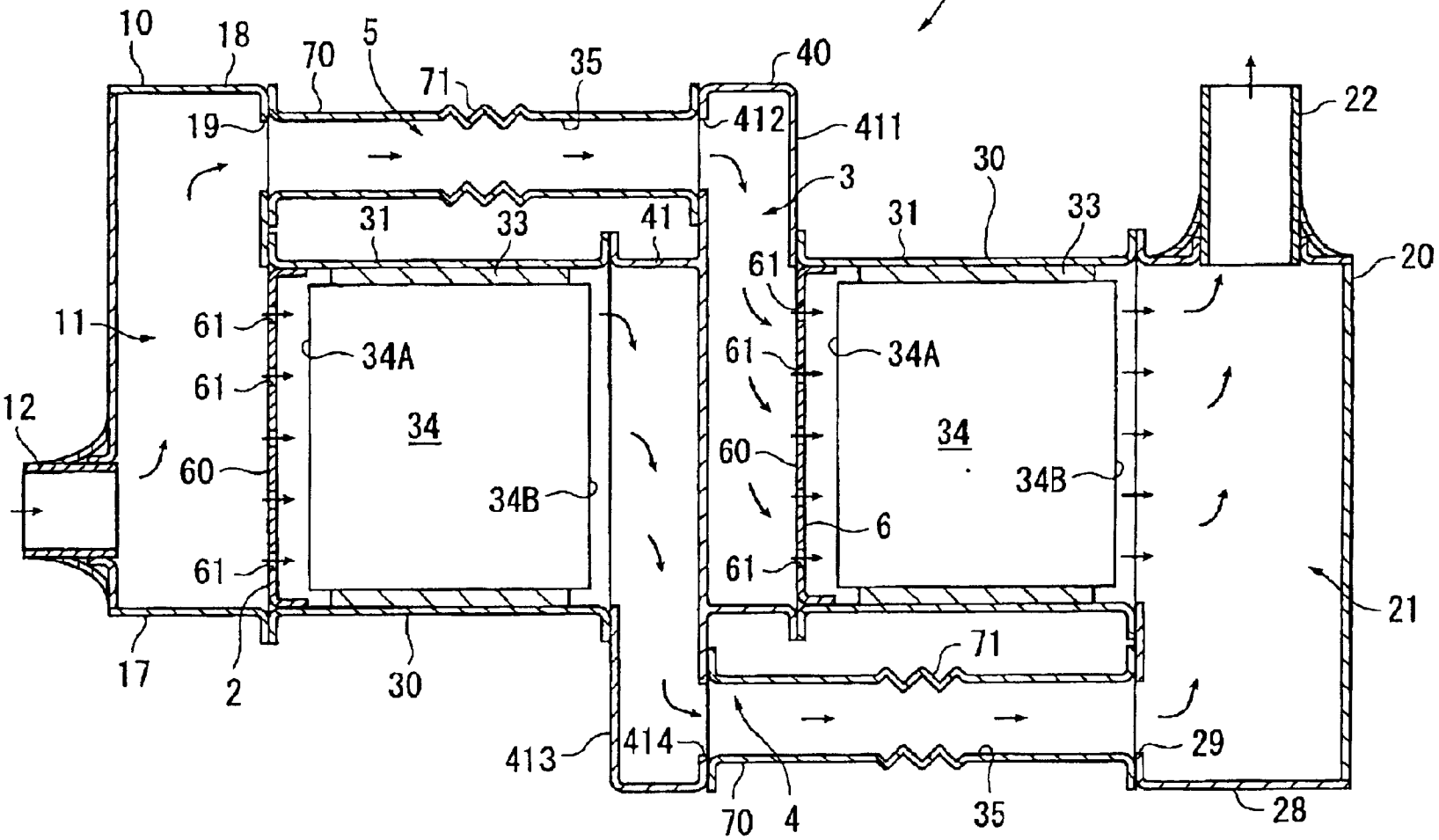
FIG. 7 is a sectional view showing a fourth modification of the present invention.
Figure 8:
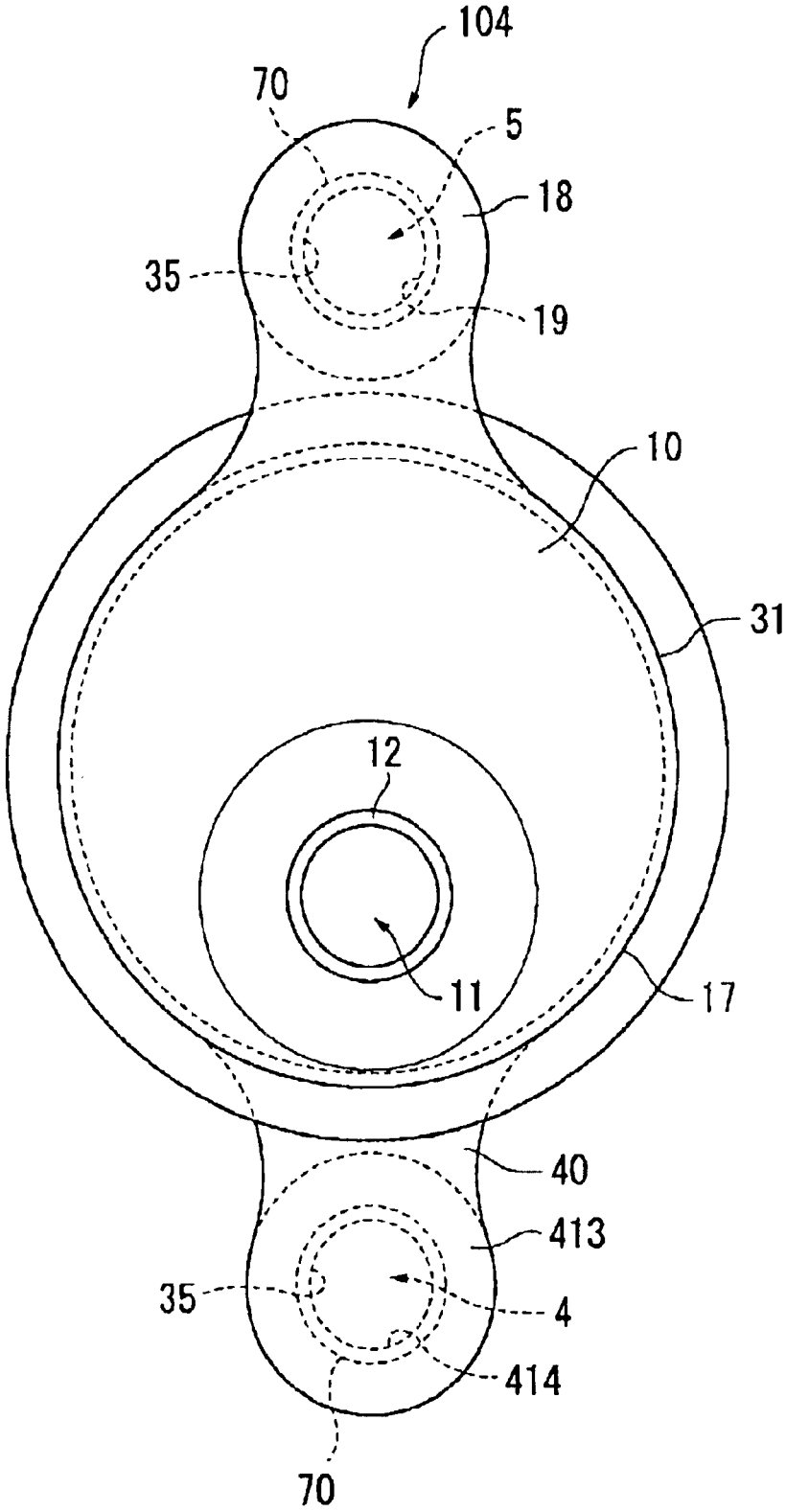
FIG. 8 is a side view showing a fourth modification of the present invention.

FIGS. 7 and 8 show an exhaust gas purifying system 104 in accordance with a fourth modification of the present invention.

The exhaust gas purifying system 104 of this fourth modification differs from the above-described embodiment not only in that the inlet pipe 12 is installed along the flow direction of the exhaust gas in the carrier 34 and that flow straightening devices 2 and 6 provided with the flow straightening grating 60 are arranged just on the upstream side of the carrier 34, but also in construction described below.

Specifically, the carrier arrangement unit 30 and the split flow unit 40 used for the exhaust gas purifying system 104 has a single tube construction having only the external cylindrical member 31, 41. The carrier 34 is disposed in the external cylindrical member 31 of the carrier arrangement unit 30, and a space in the external cylindrical member 41 of the split flow unit 40 is partitioned by the wall portion 49.

The inlet chamber unit 10 and the split flow unit 40 are provided with projecting portions 18 and 411, respectively, which project to the outer periphery side (upper side in the figure) with respect to the carrier 34, and the projecting portions 18 and 411 are provided with openings 19 and 412, respectively, which are opposed to each other. Also, between the projecting portions 18 and 411, a bypass pipe 70 is arranged so that the openings 19 and 412 communicate with each other.

On the other hand, the split flow unit 40 and the combined flow chamber unit 20 are provided with projecting portions 413 and 28, respectively, which project to the outer periphery side (lower side in the figure) with respect to the carrier 34, and the projecting portions 28 and 413 are provided with openings 29 and 414, respectively, which are opposed to each other. Also, between the projecting portions 28 and 413, the bypass pipe 70 is arranged so that the openings 29 and 414 communicate with each other.

The first distribution flow path 4 including the outlet space 47 of the split flow unit 40 and the bypass flow path 35 in the downstream-side bypass pipe 70 is formed, and the second distribution flow path 5 including the bypass flow path 35 in the upstream-side bypass pipe 70 and the inlet space 48 in the split flow unit 40 is formed.

A wavy expansion portion 71 is provided halfway in the communicating direction of the bypass pipe 70. Even if the bypass pipe 70 is expanded or contracted by the heat of exhaust gas flowing in the bypass flow path 35, the expansion or contraction is absorbed by the expansion portion 71, so that the projecting portions 18, 28, 411 and 413 are prevented from being broken.

According to the above-described modification, the bypass flow path 35 is formed by the bypass pipe 70 projectingly provided so as to be separate from the carrier 34, and does not lie on a concentric circle of the carrier 34, so that the effect of the above-described item (4) cannot be achieved sufficiently. However, by the first and second distribution flow paths 4 and 5, exhaust gas can be caused to flow individually in each of the carriers 34 arranged in series, so that the object of the present invention can be achieved sufficiently.

As another modification, for example, although two carriers 34 are arranged in series in the above-described embodiment and modifications, three or more carriers 34 may be arranged; the number of carriers is arbitrary.

In the above-described embodiment and modifications, the outlet pipe 22 is installed in the direction perpendicular to the flow direction of the exhaust gas flowing in the carrier 34. However, the outlet pipe 22 may be installed along the flow direction of exhaust gas as in the case of the inlet pipe 12 in the third and fourth modifications. Such a case is also embraced in the invention of claims other than claim 8.

The flow straightening device used for the exhaust gas purifying system in accordance with the present invention is not limited to the device used in the above-described embodiment and modifications. The specific constriction etc. thereof may be determined arbitrarily in carrying out the invention.

Also, a case in which the flow straightening device is not provided is also embraced in the invention of claims other than claim 7.

In the above-described embodiment, for example, each of the carriers 34 is arranged in individual carrier arrangement unit 30, and the split flow portion 3 is also provided in the split flow unit 40. However, the construction may be such that the carriers 34 and the split flow portion 3, having a construction similar to that of the embodiment, are contained in one large external cylindrical member. In other words, the carrier 34 and the split flow portion 3 need not be unitized. Such a case is also embraced in the invention of claims other than claims 4 and 5.

In such a large external cylindrical member, the inlet chamber 11 and the combined flow chamber 21 may be provided integrally.

Also, even in the case where the carrier arrangement unit 30 and the split flow unit 40 are used, the specific shape etc. of each of the units 30 and 40 are arbitrary, and are not limited to the single construction or the double construction.

Further, the shape, number, and the like of the outlet-side opening portion 43 and the inlet-side opening portion 44 of the split flow unit 40 can be changed appropriately in the scope in which the achievement of object of the present invention is not hindered.

What is claimed is:

1. An exhaust gas purifying system for an internal combustion engine, which is provided in an exhaust flow path of the internal combustion engine, comprising:

a plurality of carriers for exhaust emission after-treatment arranged in series along the flow direction of exhaust gas;

a distribution flow path for distributing exhaust gas to each of said carriers to cause the exhaust gas to flow in each of said carriers;

a combined flow chamber in which the exhaust gases having passed through the distribution flow paths are combined;

two of said carriers are arranged in series on the upstream side and the downstream side;

a bypass flow path is provided on a concentric circle of each of said carriers;

between said carriers, there is provided a split flow portion provided with an outlet space in which the exhaust gas having passed through the upstream-side carrier flows, an inlet space in which the exhaust gas to be caused to flow in the downstream-side carrier flows, and a wall portion for partitioning the spaces;

a first distribution flow path for the upstream-side carrier is formed so as to include the outlet space of said split flow portion and the downstream-side bypass flow path communicating with said outlet space; and a second distribution flow path for the downstream-side carrier is formed so as to include the upstream-side bypass flow path and the inlet space of said split flow portion communicating with said upstream-side bypass flow path.

2. The exhaust gas purifying system for an internal combustion engine according to claim 1, wherein a flow straightening device for straightening the flow of exhaust gas flowing in said carrier is provided on the upstream side of each of said carriers.

3. The exhaust gas purifying system for an internal combustion engine according to claim 1, wherein an inlet pipe for causing exhaust gas to flow into said exhaust gas purifying system and an outlet pipe for discharging exhaust gas from said exhaust gas purifying system are installed substantially at right angles with the flow direction of exhaust gas in said carrier.

4. An exhaust gas purifying system for an internal combustion engine, which is provided in an exhaust flow path of the internal combustion engine, comprising:

a plurality of carriers for exhaust emission after-treatment arranged in series along the flow direction of exhaust gas;

a distribution flow path for distributing exhaust gas to each of said carriers to cause the exhaust gas to flow in said carrier;

the flow direction of said exhaust gas being set in one direction, wherein two of said carriers are arranged in series on the upstream side and the downstream side;

a bypass flow path is provided on a concentric circle of each of said carriers;

between said carriers, there is provided a split flow portion provided with an outlet space in which the exhaust gas having passed through the upstream-side carrier flows, an inlet space in which the exhaust gas to be caused to flow in the downstream-side carrier flows, and a wall portion for partitioning the spaces;

a first distribution flow path for the upstream-side carrier is formed so as to include the outlet space of said split flow portion and the downstream-side bypass flow path communicating with said outlet space; and a second distribution flow path for the downstream-side carrier is formed so as to include the upstream-side bypass flow path and the inlet space of said split flow portion communicating with said upstream-side bypass flow path.

5. The exhaust gas purifying system for an internal combustion engine according to claim 4, wherein there are provided a plurality of carrier arrangement units in which the carrier is arranged individually and a split flow unit provided between the adjacent carrier arrangement units;

each of said carrier arrangement units is provided with a bypass flow path on a concentric circle of the carrier;

said split flow unit is provided with a split flow portion provided with an outlet space in which the exhaust gas having passed through the upstream-side carrier flows, an inlet space in which the exhaust gas to be caused to flow in the downstream-side carrier flows, and a wall portion for partitioning the spaces;

a distribution flow path for the upstream-side carrier is formed so as to include the outlet space of said split flow portion and the downstream-side bypass flow path communicating with said outlet space; and a distribution flow path for the downstream-side carrier is formed so as to include the upstream-side bypass flow path and the inlet space of said split flow portion communicating with said upstream-side bypass flow path.

6. The exhaust gas purifying system for an internal combustion engine according to claim 5, wherein said split flow unit has a double tube construction provided with an external cylindrical member and an internal cylindrical member;

said internal cylindrical member is provided with at least a pair of opening portions for causing external and internal space portions to communicate with each other;

in said internal cylindrical member, an internal wall for separating said paired opening portions is provided;

between said external cylindrical member and said internal cylindrical member, an external wall for separating said paired opening portions is provided;

said outlet space is formed by the external and internal space portions of said internal cylindrical member which are caused to communicate with each other by either one of said paired opening portions;

said inlet space is formed by the external and internal space portions of said internal cylindrical member which are caused to communicate with each other by the other one of said paired opening portions; and said wall portion is formed by said internal wall and said external wall.

7. The exhaust gas purifying system for an internal combustion engine according to claim 5, wherein said internal wall is tilted with respect to the flow direction of the exhaust gas in said carrier; and said opening portion is open along the peripheral edge of said internal wall.

8. The exhaust gas purifying system for an internal combustion engine according to claim 4, wherein a flow straightening device for straightening the flow of exhaust gas flowing in said carrier is provided on the upstream side of each of said carriers.

9. The exhaust gas purifying system for an internal combustion engine according to claim 4, wherein an inlet pipe for causing exhaust gas to flow into said exhaust gas purifying system and an outlet pipe for discharging exhaust gas from said exhaust gas purifying system are installed substantially at right angles with the flow direction of exhaust gas in said carrier.

10. An exhaust gas purifying system for an internal combustion engine which is provided in an exhaust flow path of the internal combustion engine, comprising:

a plurality of carriers for exhaust emission after-treatment arranged in series along the flow direction of exhaust gas;

a distribution flow path for distributing exhaust gas to each of said carriers to cause the exhaust gas to flow in each of said carriers;

a combined flow chamber in which the exhaust gases having passed through the distribution flow paths are combined, wherein there are provided a plurality of carrier arrangement units in which the carrier is arranged individually and a split flow unit provided between the adjacent carrier arrangement units, each of said carrier arrangement units is provided with a bypass flow path on a concentric circle of the carrier, and said split flow unit is provided with a split flow portion provided with an outlet space in which the exhaust gas having passed through the upstream-side carrier flows, an inlet space in which the exhaust gas to be caused to flow in the downstream-side carrier flows, and a wall portion for partitioning the spaces;

a distribution flow path for the upstream-side carrier is formed so as to include the outlet space of said split flow portion and the downstream-side bypass flow path communicating with said outlet space; and a distribution flow path for the downstream-side carrier is formed so as to include the upstream-side bypass flow path and the inlet space of said split flow portion communicating with said upstream-side bypass flow path.

* * * * *